US008650993B2

(12) United States Patent
Chen

(10) Patent No.: US 8,650,993 B2
(45) **Date of Patent: *Feb. 18, 2014**

(54) FIXING DEVICE FOR A TOOL MEMBER

(71) Applicant: Shou-Hung Chen, Taipei (TW)

(72) Inventor: Shou-Hung Chen, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/781,656

(22) Filed: Feb. 28, 2013

(65) Prior Publication Data

US 2013/0263708 A1 Oct. 10, 2013

Related U.S. Application Data

(63) Continuation-in-part of application No. 13/442,797, filed on Apr. 9, 2012.

(51) Int. Cl.

| | |
|---|---|
| ***B25G 3/00*** | (2006.01) |
| ***B25B 3/00*** | (2006.01) |
| ***B25G 1/00*** | (2006.01) |
| ***B25H 3/00*** | (2006.01) |
| ***B25B 27/00*** | (2006.01) |

(52) U.S. Cl.

USPC ..... 81/491; 81/9.26; 81/492; 81/487; 81/488

(58) Field of Classification Search

USPC ..... 81/491, 9.26, 492, 487, 488; 30/169; 15/236.01, 176.1

See application file for complete search history.

(56) References Cited

U.S. PATENT DOCUMENTS

2009/0084233 A1* 4/2009 Rosso et al. ..... 81/491

* cited by examiner

*Primary Examiner* — Monica Carter
*Assistant Examiner* — Danny Hong

(57) ABSTRACT

A fixing device for a tool member includes a handle having a receiving space opened at one end thereof for receiving a connector, the tool member having an operation head defined at one end thereof, a connecting end defined at another end of the tool member for connecting to the connector, the connector having two flat bodies which are pivoted with each other, a fixing unit defined between the two flat bodies for fixing the connecting end of the tool member to the connector, the connector having at least one engaging rib defined at one end thereof for engaging with a wall of the receiving space. Therefore, the tool member is easily detachable from the handle via the connector.

4 Claims, 7 Drawing Sheets

FIXING DEVICE FOR A TOOL MEMBER

CROSS-REFERENCE TO RELATED APPLICATION

This application is a Continuation-in-part Application of Ser. No. 13/442,797 filed 9 Apr. 2012, and entitled "FIXING DEVICE FOR A TOOL MEMBER", now pending.

BACKGROUND OF THE INVENTION

1. Field of the Invention

The present invention relates to a fixing device and more particularly to a fixing device for a tool member.

2. Description of Related Art

A tool assembly, such as a scraper assembly or a saw assembly, is often used for gardening. However, when a tool member (such as a scraper body or a saw body) of the tool assembly is broken, a user has to exchange the tool member. Therefore, a conventional fixing device for a tool member comes to the world.

The conventional fixing device for a tool member comprises a handle body. The handle body further has a connecting slot. At least one through hole is opened on the handle body. The through hole communicates with the connecting slot. A tool member has a connecting end which is formed as a slice. The connecting end has at least one fixing hole opened therethrough. The fixing hole is corresponding to the through hole. Under this arrangement, the connecting end of the tool member is inserted into the connecting slot of the handle body. At least one fixing rod is inserted into the through hole and the fixing hole, and is assembled in the handle body so that the tool member is fixed to the handle body via the fixing rod. Therefore, the conventional fixing device is provided for the user to exchange the tool member. However, the conventional fixing device still has a disadvantage as following:

The through hole and the fixing rod are usually a threaded hole and a threaded screw respectively. When the moisture in the air is absorbed by the threaded hole or the threaded screw, the threaded structure of the threaded hole or the threaded screw often oxidizes and is going to be damaged someday. Therefore, the user has to replace the whole tool assembly rather than replace the only tool member, when the tool member is damaged.

The present invention has arisen to obviate/mitigate the disadvantages of the conventional fixing device for a tool member.

SUMMARY OF THE INVENTION

The main objective of the present invention is to provide an improved fixing device.

To achieve the objective, a fixing device for a tool member comprises a handle having a receiving space opened at one end thereof for receiving a connector when the connector is inserted into the receiving space, the tool member having an operation head defined at one end thereof for a user to operate, a connecting end defined at another end of the tool member for connecting to the connector, the connector having two flat bodies which are pivoted with each other so that the connector can be opened or closed, a fixing unit defined between the two flat bodies for fixing the connecting end of the tool member to the connector, the connector having at least one engaging rib defined at one end thereof, an engaging unit extruded on a wall of the receiving space, the engaging rib of the connector engaged with the engaging unit of the handle so that the engaging rib is buckled to the engaging unit securely and the connector is fixed to the handle tightly. Wherein the fixing unit of the connector has a fixing protrusion and a fixing hole; the fixing protrusion passes through the connecting end of the tool member to be inserted into the fixing hole so that the tool member is fixed to the connector via the fixing unit; a detaching member is assembled into the handle; the engaging rib has an engaging hook defined at one end thereof; the detaching member is used to press the engaging hook of the engaging rib of the connector so as to detach the engaging rib from the engaging unit; one end of the detaching member is received in the receiving space; another end of the detaching member is exposed from the handle; the detaching member has an abutting space opened at one end thereof; when the user pushes another end of the detaching member toward the connector in the receiving space, one end of the abutting space presses the engaging rib so as to detach the engaging rib from the engaging unit; the engaging hook has a first oblique surface defined at one side thereof; the abutting space of the detaching member has a second oblique surface defined at one end thereof; the second oblique surface corresponds to the first oblique surface; when the user presses the detaching member, the second oblique surface is abutted against the first oblique surface, so that the second oblique surface of the abutting space presses the engaging rib toward a central line of the receiving space smoothly so as to detach the connector from the receiving space; the engaging unit has an engaging surface; the engaging surface abuts against the engaging hook so that the engaging rib buckles to the engaging unit; a cover is assembled at another end of the handle; the cover has a receiving room which communicates with the receiving space of the handle.

Under this arrangement, the connector is connected between the tool member and the handle via the engaging rib which is buckled to the engaging unit, and the fixing unit which fixes the connecting end of the tool member to the connector.

Further benefits and advantages of the present invention will become apparent after a careful reading of the detailed description with appropriate reference to the accompanying drawings.

DETAILED DESCRIPTION OF THE INVENTION

Figure 1:
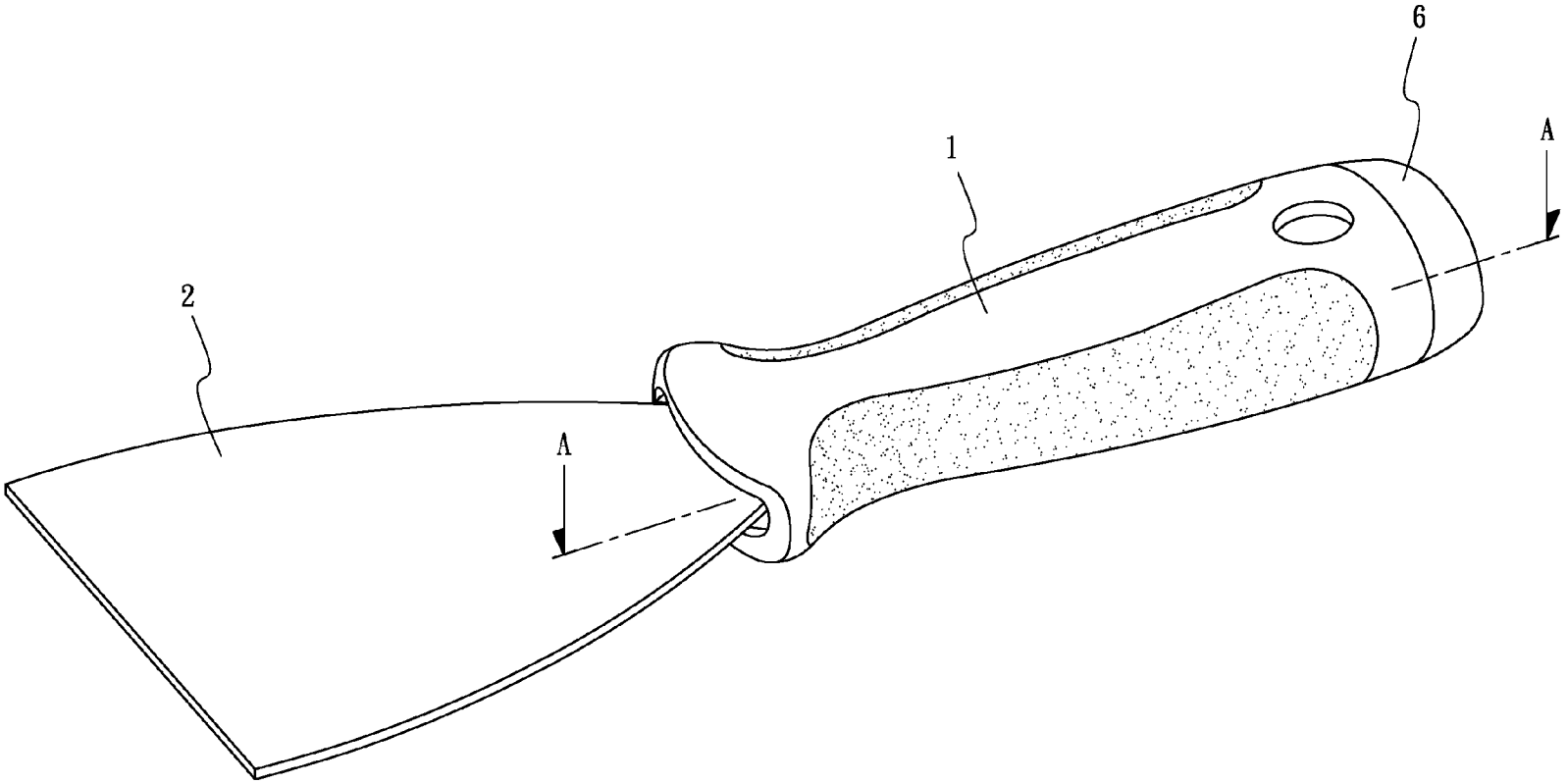
FIG. 1 is a perspective view of a fixing device for a tool member of the present invention.

Referring to FIGS. 1-4, a fixing device for a tool member 2 in accordance with the present invention comprises a handle 1, the tool member 2 and a connector 3. The handle 1 has a receiving space 11 defined therethrough. The receiving space 11 is used to receive the connector 3 when the connector 3 is inserted into the receiving space 11. The connector 3 is received in one end of the receiving space 11 of the handle 1. The tool member 2 has an operation head 21 defined at one end thereof. The operation head 21 is provided for a user to operate. A connecting portion 22 is defined at the other end of the tool member 2. The connecting portion 22 is connected to the connector 3. The connector 3 has two flat bodies 31. The two flat bodies 31 are pivoted with each other so that the connector 3 can be opened or closed so as to clamp the connecting portion 22 of the tool member 2. The connector 3 has a fixing unit 311 to fix the connecting portion 22 of the tool member 2. The connector 3 has at least one flexible rib 312 extended from the flat bodies 31 (in a preferred embodiment of the present invention, the connector 3 has two flexible ribs). The flexible rib 312 is used to engage with a wall of the receiving space 11, so that the flexible rib 312 is buckled to the wall of the receiving space 11 securely. The above description is enough to perform the priority embodiment of the present invention.

Under this arrangement, the connector 3 is connected between the tool member 2 and the handle 1 via the flexible rib 312 which is engaged with the wall of the receiving space 11 so that the flexible rib 312 is buckled to the wall of the receiving space 11 securely, and the fixing unit 311 which fixes the connecting portion 22 to the connector 3. When the user wants to detach the tool member 2 from the handle 1, the user disengages the flexible rib 312 from the wall of the receiving space 11 to disconnect the connector 3 from the handle 1, and then opens the connector 3 to disconnect the connecting portion 22 of the tool member 2 from the fixing unit 311 of the connector 3 so that the tool member 2 is detached from the handle 1 via the connector 3.

Figure 2:
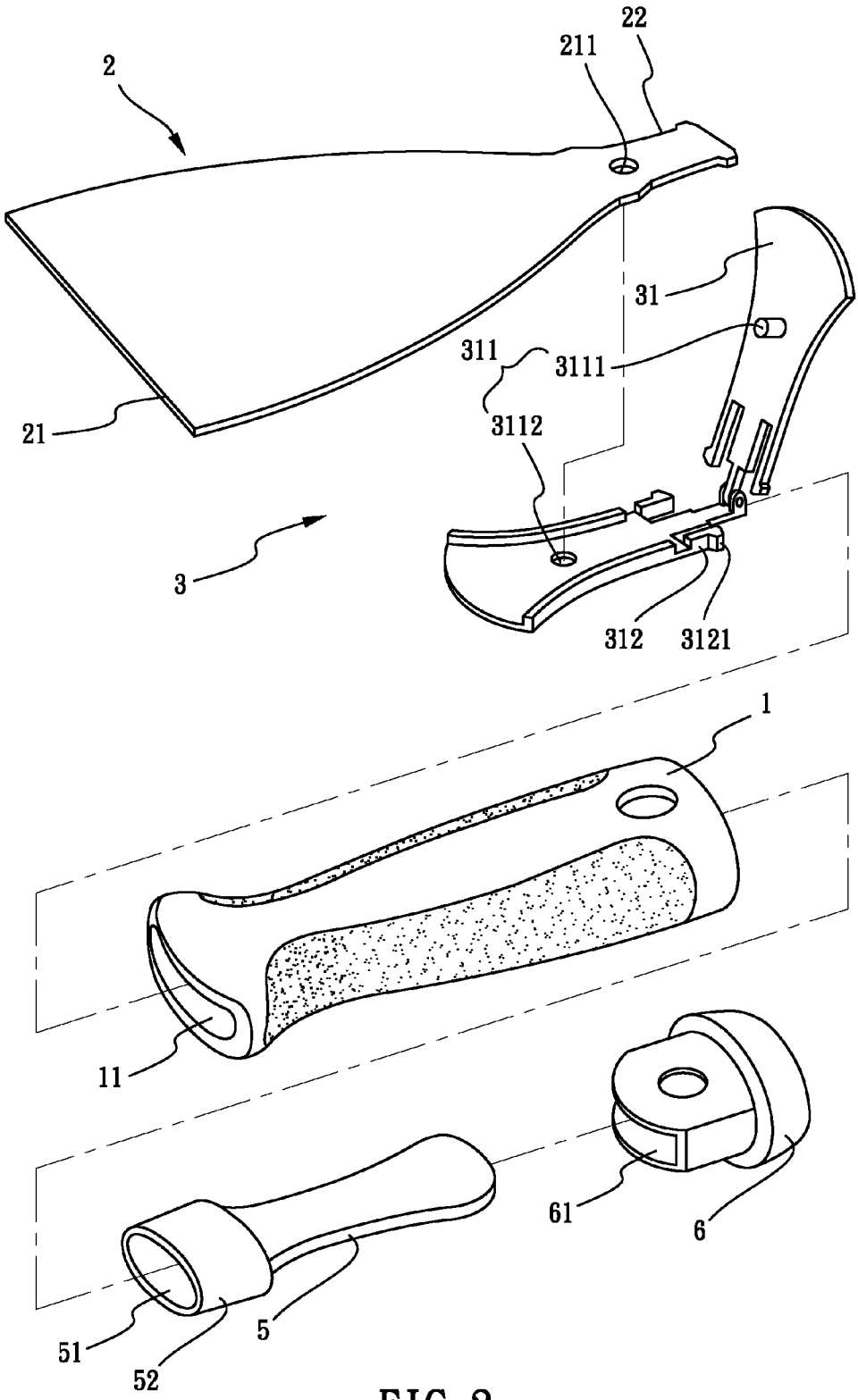
FIG. 2 is an exploded view of the fixing device for a tool member of the present invention.

Referring to FIG. 2, the fixing unit 311 of the connector 3 has a fixing protrusion 3111 and a fixing hole 3112. The fixing protrusion 3111 is protruded from one of the two flat bodies 31 and the fixing hole 3112 is defined in the other flat body 31. The fixing protrusion 3111 passes through the connecting portion 22 of the tool member 2 to be inserted into the fixing hole 3112 so that the tool member 2 is fixed to the connector 3 via the fixing unit 311. Furthermore, the connecting portion 22 of the tool member 2 has a through hole 211. The fixing protrusion 3111 passes through the through hole 211 of the connecting portion 22 to be inserted into the fixing hole 3112 so that the tool member 2 is fixed to the connector 3 via the fixing unit 311.

Figure 3:
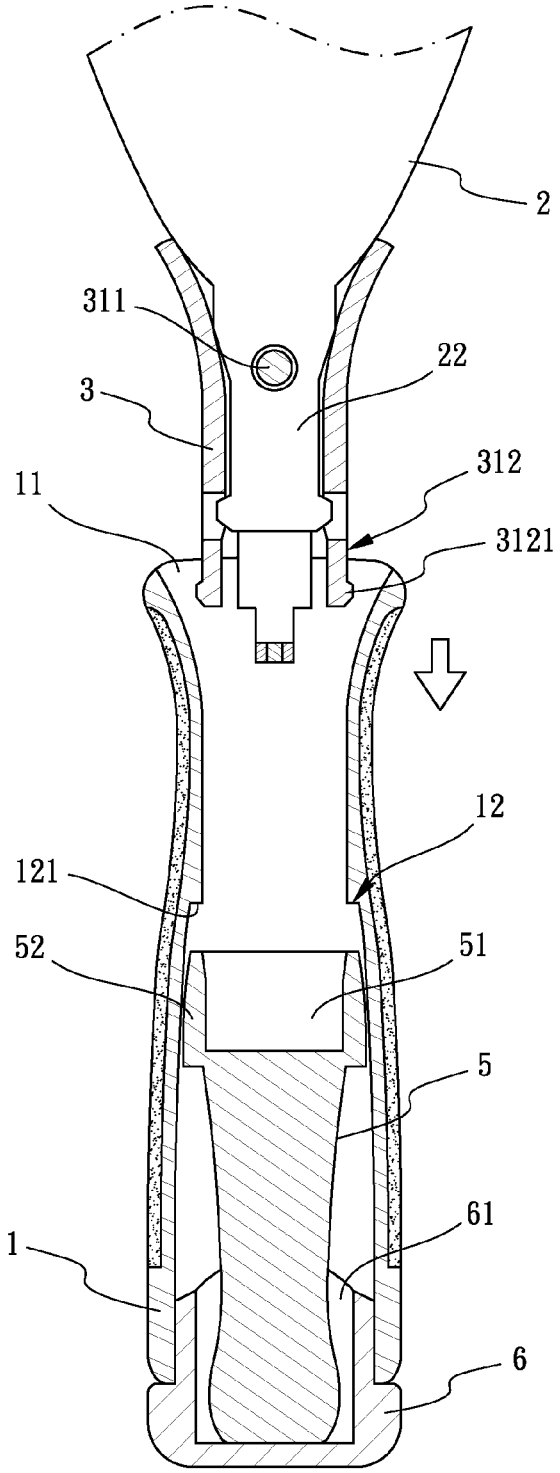
FIG. 3 is a cross-sectional view along a line AA in FIG. 1 for showing a tool member before inserted into a handle.
Figure 4:
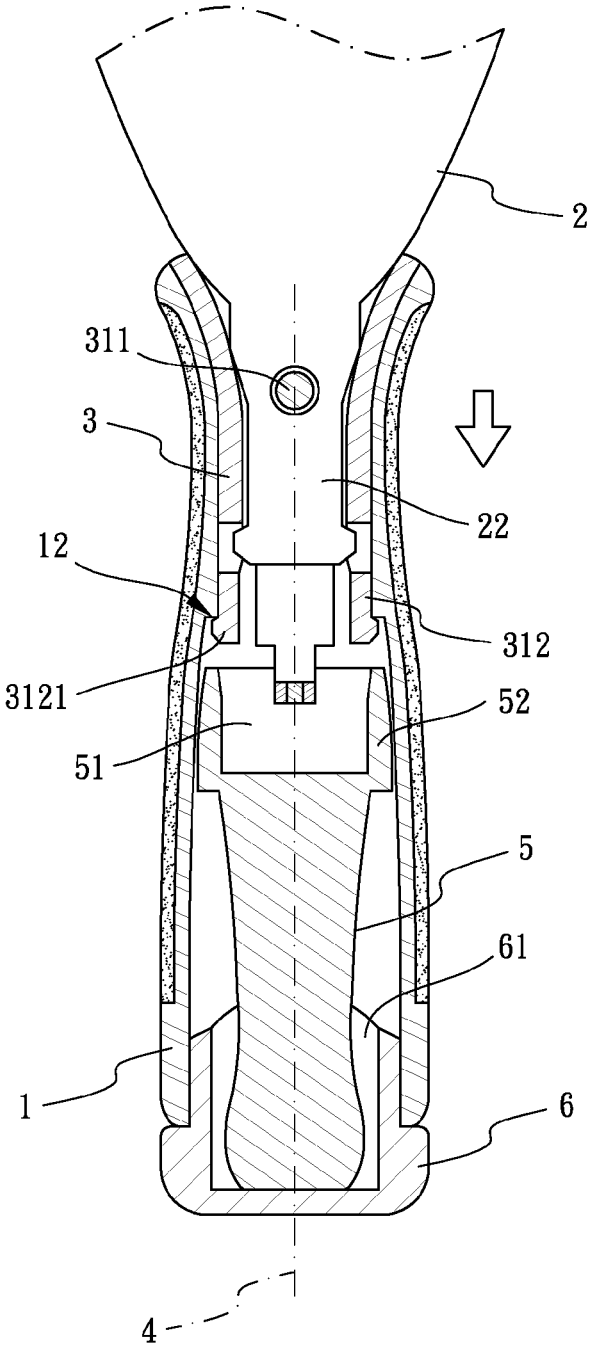
FIG. 4 is a cross-sectional view along the line AA in FIG. 1 for showing the tool member after inserted into the handle.

Referring to FIGS. 3-4, a shoulder 12 is defined on the inner wall of the receiving space 11. The flexible rib 312 has a bump 3121 defined at one side thereof. The bump 3121 of the flexible rib 312 of the connector 3 is engaged with the shoulder 12 of the handle 1 so that the flexible rib 312 is buckled to the shoulder 12 securely and the connector 3 is fixed to the handle 1 tightly. A central line 4 is hypothetically defined at the center of the receiving space 11. Under this arrangement, when the user wants to connects the tool member 2 to the handle 1, the user fixes the tool member 2 to the connector 3 at first as the above description. Then, the user inserts the connector 3 into the receiving space 11 of the handle 1. Thereafter, the flexible rib 312 of the connector 3 is pressed toward the central line 4 by the wall of the receiving space 11. Finally, the flexible rib 312 is engaged with the shoulder 12 of the handle 1 via a recovery force of the flexible rib 312, so that the flexible rib 312 is buckled to the shoulder 12 securely. Therefore, the tool member 2 is connected to the handle 1 via the connector 3. Furthermore, the shoulder 12 has an engaging surface 121. The engaging surface 121 abuts against the bump 3121 so that the flexible rib 312 is engaged with the shoulder 12.

Figure 5:
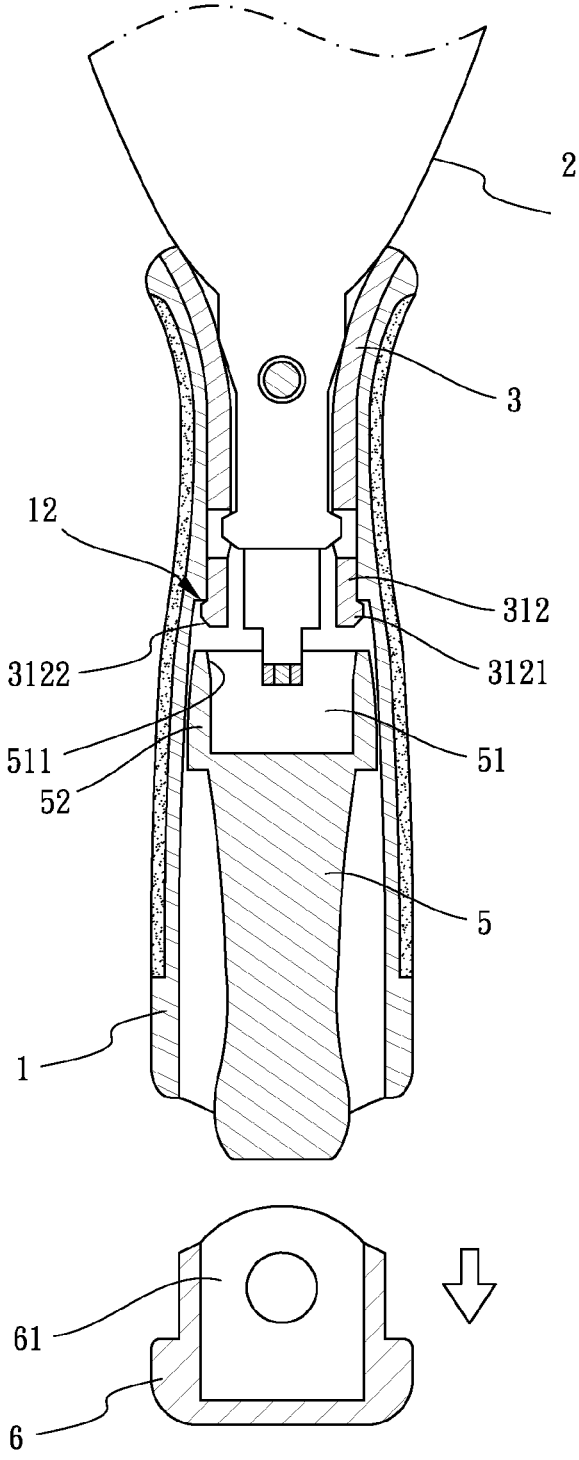
FIG. 5 is a cross-sectional view along the line AA in FIG. 1 for showing a cover which is drew from the handle.
Figure 6:
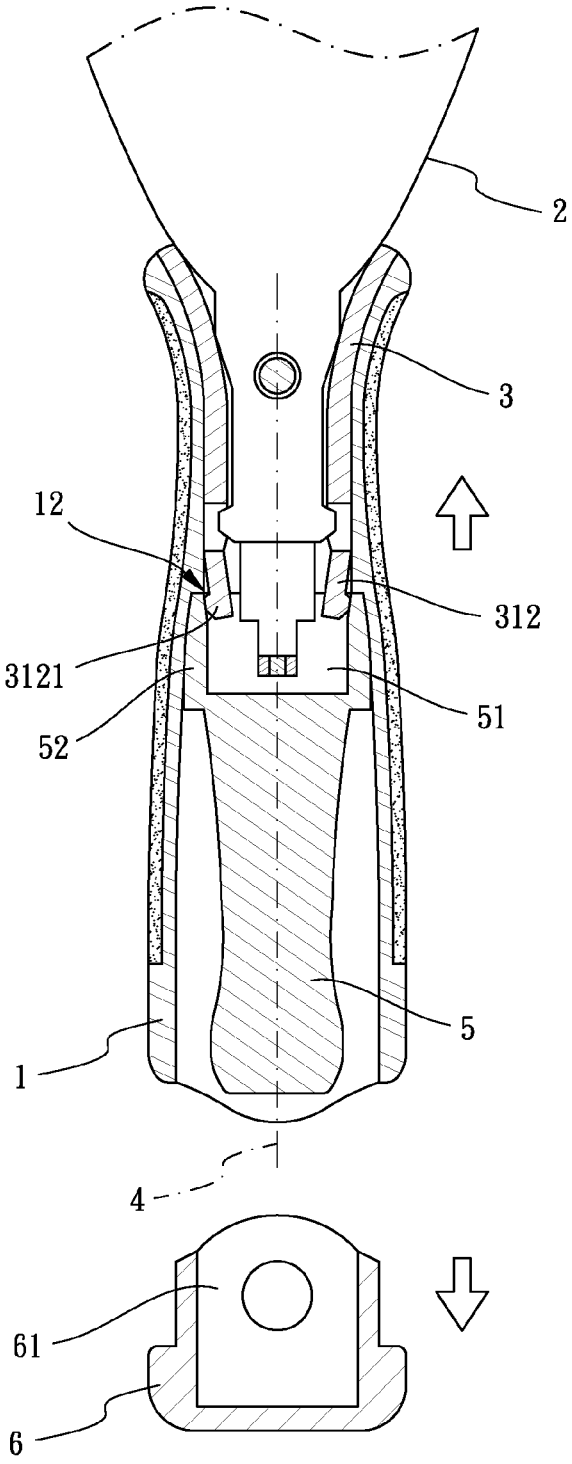
FIG. 6 is a cross-sectional view along the line AA in FIG. 1 for showing a detaching member which is pushed toward the connector 3.
Figure 7:
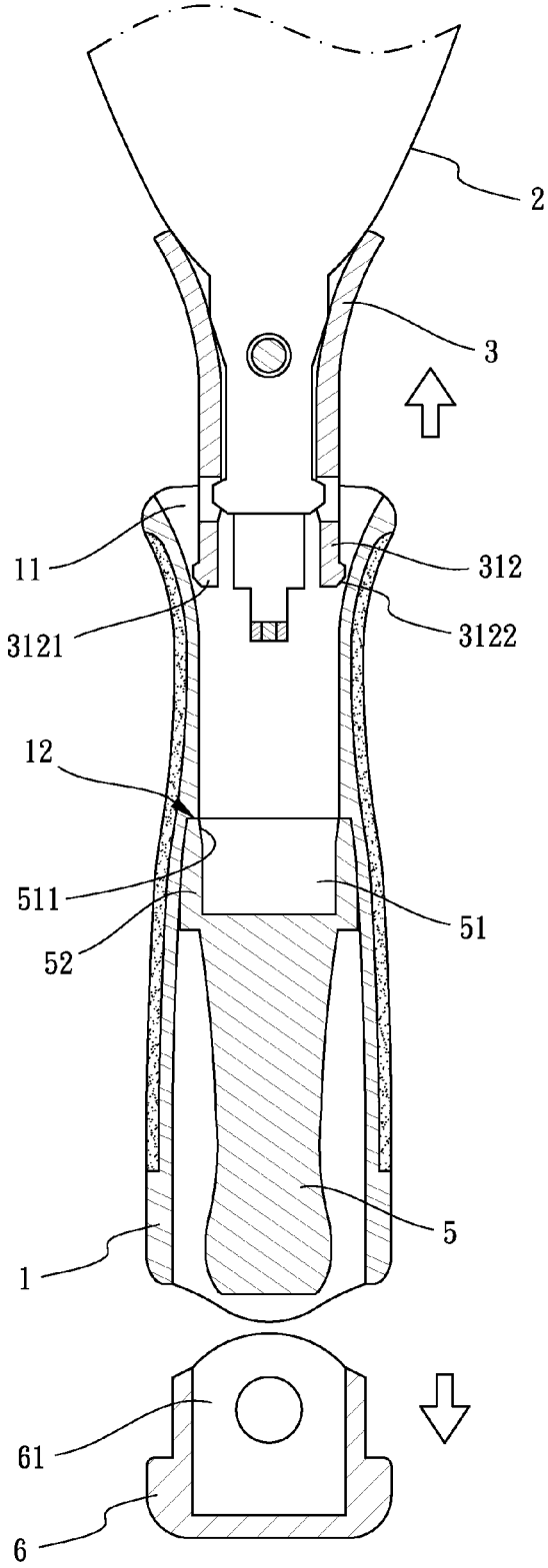
FIG. 7 is a cross-sectional view along the line AA in FIG. 1 for showing the tool member which is detached from the handle.

Referring to FIGS. 5-7, a detaching member 5 is axially movably received in the other end of the receiving space 11 of the handle 1. One end of the detaching member 5 is received in the receiving space 11. Another end of the detaching member 5 is exposed from the handle 1. The detaching member 5 has an extending portion 52 and an abutting space 51 defined in the extending portion 52. Under this arrangement, when the user wants to detach the tool member 2 from the handle 1, the user pushes the detaching member 5 toward the connector 3 in the receiving space 11 at first. Then, the extending portion 52 of the detaching member 5 presses the flexible rib 312 toward the central line 4 so as to detach the flexible rib 312 from the shoulder 12. Finally, the user directly draws the tool member 2 from the receiving space 11 of the handle 1. Therefore, the tool member 2 is detached from the handle 1.

Furthermore, the bump 3121 has a first oblique surface 3122 defined at one side thereof. The extending portion 52 of the detaching member 5 has a second oblique surface 511 defined at one end thereof. The second oblique surface 511 corresponds to the first oblique surface 3122. Under this arrangement, when the user inserts the connector 3 into the receiving space 11 of the handle 1, the first oblique surface 3122 of the bump 3121 is abutted against the wall of the receiving space 11. Thereafter, the flexible rib 312 of the connector 3 is pressed toward the central line 4 by the wall of the receiving space 11. Finally, the flexible rib 312 is buckled to the shoulder 12 of the handle 1 via the recovery force of the flexible rib 312. In contrast, when the user pushes the detaching member 5, the second oblique surface 511 of the extending portion 52 of the detaching member 5 is abutted against the first oblique surface 3122 of the bump 3121, so that the second oblique surface 511 of the extending portion 52 of the detaching member 5 pushes the bump 3121 of the flexible rib 312 toward the central line 4 and aside from the shoulder 12 of the handle 1 so as to detach the connector 3 from the receiving space 11.

Referring to FIGS. 3-4, a cover 6 is assembled at another end of the handle 1. The cover 6 has a receiving room 61 which communicates with the receiving space 11 of the handle 1. Another end of the detaching member 5 is protected in the receiving room 61 from being unexpectedly pushed toward the connector 3 by the user during the operation. Therefore, cover 6 further prevents the tool member 2 from being unexpectedly detached from the handle 1 by the user during the operation.

Although the invention has been explained in relation to its preferred embodiment, it is to be understood that many other possible modifications and variations can be made without departing from the spirit and scope of the invention as hereinafter claimed.

What is claimed is:

1. A hand tool comprising:

a handle having a receiving space defined therethrough, and a shoulder defined on an inner wall of the receiving space;

a tool member having an operation head at one end and a connecting portion at the other end thereof;

a connector received in one end of the receiving space of the handle and having two flat bodies pivoted with each other for clamping the connecting portion of the tool member, and at least one flexible rib extending from the two flat bodies, the flexible rib having a bump defined at one side thereof, the bump of the flexible rib being engaged with the shoulder of the handle so as to lock the connector in the handle; and a detaching member axially movably received in the other end of the receiving space of the handle with one end, and exposed from the handle with the other end, the detaching member including an extending portion having an oblique surface corresponding to an oblique surface of the bump of the flexible rib;

wherein the detaching member is configured to be pushed toward the connector so as to have the oblique surface of the extending portion of the detaching member abut against the oblique surface of the bump of the flexible rib and therefore push the bump of the flexible rib aside from the shoulder of the handle.

2. The hand tool as claimed in claim 1, wherein the shoulder of the handle has an engaging surface; the engaging surface abuts against the bump so that the flexible rib is fastened to the shoulder.

3. The hand tool as claimed in claim 1, further comprising a cover assembled at another end of the handle; and the cover has a receiving room which communicates with the receiving space of the handle.

4. The hand tool as claimed in claim 1, wherein the connecting portion of the tool member has a through hole; the connector has a protrusion protruded from one of the two flat bodies and a fixing hole defined in the other flat body; and the protrusion of the connector passes through the through hole of the connecting portion of the tool member and is engaged in the fixing hole of the flat body.

* * * * *